US007717808B2

(12) United States Patent
Watanabe

(10) Patent No.: US 7,717,808 B2
(45) **Date of Patent: *May 18, 2010**

(54) GOLF BALL

(75) Inventor: Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 249 days.

This patent is subject to a terminal disclaimer.

(21) Appl. No.: 11/429,319

(22) Filed: May 8, 2006

(65) Prior Publication Data

US 2007/0259737 A1 Nov. 8, 2007

(51) Int. Cl.
*A63B 37/00* (2006.01)

(52) U.S. Cl. ..... 473/351

(58) Field of Classification Search ..... 473/351
See application file for complete search history.

(56) References Cited

U.S. PATENT DOCUMENTS 4,836,552 A 6/1989 Puckett et al.
5,209,485 A 5/1993 Nesbitt et al.
5,273,287 A 12/1993 Molitor et al.
5,695,413 A 12/1997 Yamagishi et al.
5,971,870 A 10/1999 Sullivan et al.
7,322,892 B1 * 1/2008 Watanabe ..... 473/373
2002/0187856 A1 * 12/2002 Endou ..... 473/371
2003/0190978 A1 * 10/2003 Maruko et al. ..... 473/371
2004/0106478 A1 * 6/2004 Hayashi et al. ..... 473/378

FOREIGN PATENT DOCUMENTS

JP 60-194967 A 10/1985

* cited by examiner

*Primary Examiner*—Raeann Trimiew
(74) *Attorney, Agent, or Firm*—Sughrue Mion, PLLC

(57) ABSTRACT

The present invention provides a golf ball having a resilient core made of rubber and a cover of one or more layer enclosing the core, wherein, letting V be the initial velocity (m/s) of the ball as measured by a method set forth in the Rules of Golf using an initial velocity measuring apparatus of the same type as the USGA drum rotation-type initial velocity instrument and letting E be the deflection (mm) of the ball when subjected to loading from an initial load state of 98 N (10 kgf) to a final load of 1.275 N (130 kgf), the value of V/E is at most 19. The golf ball has a good feel on impact and an excellent flight performance when hit with an iron.

11 Claims, 2 Drawing Sheets

GOLF BALL

BACKGROUND OF THE INVENTION

The present invention relates to a golf ball having a reduced distance compared with official golf balls in current use.

There are primarily two sets of Rules of Golf: one issued by the Royal and Ancient Golf Club of St. Andrews (R&A) and one issued by the United States Golf Association. Both are revised every few years to maintain the integrity of golf competition. Investigations on limiting the distance of golf balls in these Rules of Golf are slowly being carried out. The dramatic improvements over the past few years in the total distance and initial velocity of golf balls appear to be due not only to improvements in the skill and strength of golfers, but also to the increased use of systems which can easily match golf equipment to the swing of an individual player and to improvements in the performance of golf clubs and balls. Concerning the use of golf clubs and balls in particular, golf course officials have begun voicing the opinion that consideration be given to restricting to some degree the distance and rebound of golf balls so as to keep the standard number of strokes on a golf course the same as up until now (par 72) without having to increase the length of the course.

Of the golf balls that have been disclosed to date, a few are golf balls which intentionally limit the flight performance or are designed to travel a short distance. For example, JP-A 60-194967 describes a short distance golf ball which includes a foam-molded thermoplastic resin polymer and filler material, and has a density gradient that increases along the radius thereof from the center to the surface of the ball.

However, this golf ball undergoes an excessive loss of distance not only at high head speeds, but also at low head speeds, making it too disadvantageous to the golfer in competition.

U.S. Pat. No. 5,209,485 teaches a golf ball which has a low rebound and reduced distance. However, this ball has a high hardness and thus an unpleasant feel on impact.

U.S. Pat. No. 5,273,287 discloses a large-diameter golf ball having a diameter of 1.70 to 1.80 inches (43.18 to 45.72 mm), a weight of not more than 1.62 ounces, and a dimple surface coverage of at least 70% relative to the spherical surface of the ball. Yet, because the ball is larger than normal, it feels strange to the player. Moreover, the feel on impact has not been improved.

U.S. Pat. No. 5,971,870 and U.S. Pat. No. 5,695,413 describe golf balls having a soft core. However, because the purpose of these inventions is to provide a good flight performance, they differ from the present invention in their fundamental aims.

SUMMARY OF THE INVENTION

It is therefore an object of the present invention to provide a golf ball which has a reduced distance compared with official golf balls in current use, yet has a relatively soft and good feel on impact, and which minimizes the extent of the decrease in distance by the ball when hit with an iron, and thus has little adverse effect on play by the amateur golfer.

I have found from extensive investigations that, by optimizing the relationship between the initial velocity and deflection of the ball, more specifically, by having the golf ball composed of a resilient core made of rubber and a cover of one or more layer enclosing the core such that, letting V be the initial velocity (m/s) of the ball as measured by a method set forth in the Rules of Golf using an initial velocity measuring apparatus of the same type as the USGA drum rotation-type initial velocity instrument and letting E be the deflection (mm) of the ball when subjected to loading from an initial load state of 98 N (10 kgf) to a final load of 1.275 N (130 kgf), the value V/E is at most 19, the ball travels a shorter distance when hit with a number one wood, but undergoes surprisingly little decline in distance when hit with an iron. Moreover, within the above range in the numerical value of the initial velocity (m/s) divided by the ball deflection, a good feel can be obtained on impact.

Accordingly, the invention provides the following golf balls.

[1] A golf ball which includes a resilient core made of rubber and a cover of one or more layer enclosing the core, wherein, letting V be the initial velocity (m/s) of the ball as measured by a method set forth in the Rules of Golf using an initial velocity measuring apparatus of the same type as the USGA drum rotation-type initial velocity instrument and letting E be the deflection (mm) of the ball when subjected to loading from an initial load state of 98 N (10 kgf) to a final load of 1.275 N (130 kgf), the value of V/E is at most 19.

[2] The golf ball of [1], wherein the value of V/E is at most 18.8.

[3] The golf ball of [1], wherein the deflection E of the ball is at least 2.8 mm.

[4] The golf ball of [1], wherein the initial velocity V of the ball is at least 65 m/s but not more than 77 m/s.

[5] The golf ball of [1], wherein the cover has a Shore D hardness of at least 30 but not more than 60.

[6] The golf ball of [1], wherein, letting S be the deflection (mm) of the core when subjected to loading from an initial load of 98 N (10 kgf) to a final load of 1.275 N (130 kgf), $-0.2 \leqq S-E \leqq 0.5$.

[7] The golf ball of [1], wherein the ball has a deflection (mm) when subjected to loading from an initial load of 1.96 N (0.2 kgf) to a final load of 49 N (5.0 kgf) of at least 0.27 but not more than 0.6.

[8] The golf ball of [1], wherein the ball has a diameter, weight and initial velocity in accordance with the R&A Rules of Golf at the time of filing.

BRIEF DESCRIPTION OF THE DIAGRAMS

DETAILED DESCRIPTION OF THE INVENTION

Figure 1:
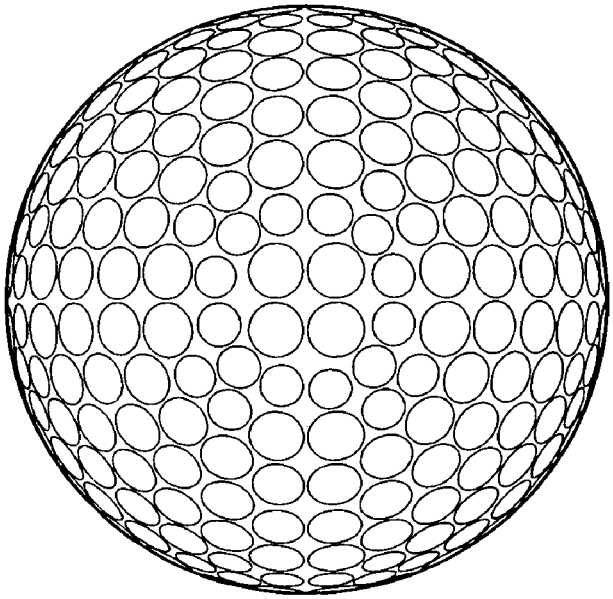
FIG. 1 is a top view of a golf ball showing dimple arrangement pattern I.

In the golf ball of the invention, letting V be the initial velocity (m/s) of the ball, as measured by a method set forth in the Rules of Golf using an initial velocity measuring apparatus of the same type as the USGA drum rotation-type initial velocity instrument, and letting E be the deflection (mm) of the ball when subjected to loading from an initial load state of 98 N (10 kgf) to a final load of 1.275 N (130 kgf), the value of V/E is at most 19.

That is, at a given initial velocity obtained by measurement with an initial velocity instrument for balls according to a method set forth in the Rules of Golf (instrumental initial velocity), excluding cases where the ball is hit by one of the small number of high head speed golfers having a head speed of more than 50 m/s, the initial velocity obtained when the ball is actually hit with a club (actual initial velocity)

decreases. At a ball deflection that is about 0.1 mm greater, the actual initial velocity at a head speed (HS) of 50 m/s drops by 0.14 m/s, the actual initial velocity at a head speed (HS) of 45 m/s drops by 0.10 m/s, and the actual initial velocity at a head speed (HS) of 40 m/s drops by 0.04 m/s. Hence, increasing the deflection of the ball lowers the actual initial velocity, and thus shortens the distance traveled by the ball. Moreover, lowering the instrumental initial velocity will effectively lower the actual initial velocity, thus reducing the distance traveled by the ball. Based on the above, to exclude golf balls which are hard and have a high instrumental initial velocity as measured by a method set forth in the Rules of Golf and design golf balls which are relatively soft and have a low instrumental initial velocity, the value obtained by dividing the instrumental initial velocity of the ball measured according to a method set forth in the Rules of Golf by the deflection of the ball was set within a given range; i.e., at or below a specific value.

It is preferable for the golf ball core to have a compressive deflection when subjected to loading from an initial load of 10 kgf to a final load of 130 kgf, of at least 2.8 mm, preferably at least 3.0 mm, and most preferably at least 4.0 mm, but not more than 6.0 mm, preferably not more than 5.5 mm, and most preferably not more than 5.0 mm. If this value is too small, the feel on impact may be too hard and the initial velocity may be too rapid, as a result of which the desired distance-reducing effect may not be obtained. Conversely, if this value is too large, the feel on impact may be too soft, the durability of the ball to cracking on repeated impact may decline, and the rebound may become so low as to cause an excessive decline in the distance traveled by the ball even when hit with an iron.

In the present invention, the initial velocity (m/s) of the ball is a value measured using an initial velocity measuring apparatus of the same type as the USGA drum rotation-type initial velocity instrument approved by the R&A. The ball was temperature conditioned in a 23±1° C. environment for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity (m/s) of the ball. This cycle was carried out over a period of about 15 minutes.

The initial velocity of the golf ball is preferably at least 65 m/s, more preferably at least 70 m/s, and even more preferably at least 75 m/s, but preferably not more than 77 m/s, more preferably not more than 76.6 m/s, and even more preferably not more than 76.3 m/s. If this initial velocity is too large, it may not be possible to sufficiently reduce the distance traveled by the ball when hit with a number one wood (W#1). On the other hand, if this initial velocity is too small, the distance traveled by the ball may decrease excessively not only when hit with a W#1, but even when hit with an iron.

Letting the initial velocity (m/s) be V and the deflection (mm) be E, it is critical for the value V/E obtained when the initial velocity is divided by the deflection to be 19 or less. The value V/E is preferably 18.8 or less, and more preferably 18.6 or less. If this value is too large, the actual initial velocity of the ball when hit with a W#1 will be too fast, as a result of which it may not be possible to reduce the distance traveled by the ball. The lower limit in the value V/E is preferably at least 10.0, more preferably at least 13.0, and even more preferably at least 16.0. If this value is too small, the actual initial velocity may be too low, which may result in an excessive decrease in the distance traveled by the ball when hit with an iron.

The golf ball of the invention has a deflection when subjected to loading from an initial load state of 1.96 N (0.2 kgf) to a final load of 49 N (5.0 kgf) of at least 0.27 mm but nor more than 0.6 mm, preferably at least 0.30 mm but not more than 0.5 mm, and more preferably at least 0.33 mm but not more than 0.45 mm. If this value is too small, the ball may have too high an initial velocity, which may make it impossible to reduce the distance traveled by the ball. Conversely, if this value is too large, when the ball is hit with an iron, it may undergo an excessive rise in spin, causing the ball to describe a high trajectory which may excessively shorten the distance of travel.

The foregoing deflection is a numerical value that serves as an indicator of the effect on the performance of the ball when a small impact is applied thereto. This deflection tends to increase when the thickness of the soft cover increases, and tends to decrease when the cover is harder.

As shown above, the inventive golf ball has an optimized relationship between the initial velocity V (m/s) and deflection (mm), and has a ball construction that includes a resilient core and one or more cover layer enclosing the core.

The core has a diameter of generally at least 32.7 mm but not more than 41.9 mm, preferably at least 35.7 mm but not more than 40.7 mm, and more preferably at least 38.3 mm but not more than 39.7 mm. If the core is too large, the durability of the ball to cracking on repeated impact may become too poor. Conversely, if the core is too small, the ball may take on too much spin when hit with an iron and describe too high a trajectory, which may result in an excessive decrease in distance.

The core has a compressive deflection, when subjected to loading from an initial load of 10 kgf to a final load of 130 kgf, of typically at least 2.8 mm, preferably at least 3.0 mm, and most preferably at least 4.0 mm, but generally not more than 6.0 mm, preferably not more than 5.5 mm, and more preferably not more than 5.0 mm. If this value is too small, the feel of the ball on impact may be too hard and the initial velocity may be too high, which may prevent the desired distance-reducing effect from being achieved. Conversely, if the foregoing deflection is too large, the feel on impact may become too soft, the durability to cracking on repeated impact may diminish, and the rebound may undergo an excessive decrease, resulting in too great a reduction in the total distance traveled by the ball when hit with an iron.

The difference S−E between the core deflection S and the ball deflection E is generally at least −0.2 mm but not more than 0.5 mm, preferably at least 0 mm but not more than 0.4 mm, and more preferably at least 0.1 mm but not more than 0.3 mm. If the difference S−E is too large, the durability to cracking on repeated impact may be unacceptably poor and the feel on impact even in the short game may be too hard. Conversely, if the difference S−E is too small, when hit with an iron, the ball may take on too much spin, causing it assume a high trajectory which may excessively shorten the distance traveled by the ball.

The core has a surface hardness, in Shore D hardness units, of generally at least 25 but not more than 60, preferably at least 30 but not more than 57, and more preferably at least 35 but not more than 47. The core has a center hardness, in Shore D hardness units, of generally at least 25 but not more than 43, preferably at least 28 but not more than 40, and more preferably at least 32 but not more than 37. The Shore D hardness is a measured value obtained with a type D durometer in accordance with ASTM D2240. In measuring the surface hardness of the core, measurements were taken after setting the indenter substantially perpendicular to the curved surface. For both the surface and center of the core, hardness values that are too high tend to result in too hard a feel on impact and an excessive initial velocity which may make it impossible to achieve a distance-reducing effect. Conversely, hardness values that are too low may give the ball too soft a feel or may lower the rebound too much, possibly resulting in an excessive reduction in the distance traveled by the ball.

The difference between the core surface hardness and the core center hardness, in terms of Shore D hardness units, is generally at least 0 but not more than 15, preferably at least 3 but not more than 12, and more preferably at least 5 but not more than 10. If the difference in these values is too large, the durability to cracking on repeated impact may be unacceptably poor. On the other hand, if this difference in hardness is too small, the ball may take on excessive spin, resulting in a loss in the distance traveled by the ball even on shots taken with an iron.

The resilient core is composed of a synthetic rubber. It particular, the core may be formed of a rubber composition made primarily of polybutadiene, with fabrication being carried out by a conventional method. The resilient core may be formed by, for example, blending 100 parts by weight of cis-1,4-polybutadiene with at least 10 parts by weight but not more than 60 parts by weight of one or a mixture of two or more crosslinking agents selected from among α,β-monoethylene unsaturated carboxylic acids such as acrylic acid and methacrylic acid, metal ion neutralization products thereof and functional monomers such as trimethylolpropane methacrylate, at least 5 parts by weight but not more than 30 parts by weight of a filler such as zinc oxide or barium sulfate, at least 0.5 parts by weight but not more than 5 parts by weight of a peroxide such as dicumyl peroxide and, if necessary, at least 0.1 part by weight but nor more than 1 part by weight of an antioxidant. The rubber composition is then crosslinked under applied pressure, and subsequently molded under heat and pressure into a spherical shape at a temperature of at least 140° C. but not more than 170° C. for a period of at least 10 minutes but not more than 40 minutes.

The cover used in the present invention is formed as one or more layer around the above-described resilient core. The Shore D hardness and thickness of each cover layer is preferably optimized as described below.

Each cover layer has a Shore D hardness of preferably at least 30 but not more than 60, more preferably at least 40 but nor more than 55, and even more preferably at least 45 but not more than 50. If the respective cover layers are harder than the above range, the initial velocity of the ball may be too high, as a result of which it may not be possible to reduce the distance of the ball. Conversely, if the respective cover layers are too soft, the ball may take on too much spin when hit with an iron and assume a high trajectory, which may result in an excessive decrease in the distance traveled by the ball. As used herein, the Shore D hardness of a cover layer is the value measured for a sheet-like specimen using a type D durometer in accordance with ASTM D2240.

The cover has a thickness (a combined thickness if there are a plurality of cover layers) of generally at least 0.4 mm but not more than 5.0 mm, preferably at least 1.0 but not more than 3.5 mm, and more preferably at least 1.5 mm but not more than 2.2 mm. If the cover is too thin, the durability to cracking under repeated impact may be excessively poor. On the other hand, if the cover is too thick, when the ball is hit with an iron, it may take on too much spin and describe a high trajectory that may result in an excessive decrease in distance.

The cover layer material is preferably any of various known thermoplastic resins or elastomers, such as an ionomer resin, urethane resin, polyolefin elastomer, polyester elastomer resin or polyamide elastomer. If the cover has two or more layers, the respective cover layers may be made of the same or different materials. In particular, the use of an ionomer resin or a thermoplastic polyurethane elastomer is especially preferred. To improve productivity, it is preferable to use a thermoplastic resin.

When an ionomer resin is selected as the cover layer material, for the sake of durability, it is preferable to use a mixed ionomer resin containing a zinc (Zn) ion-type ionomer and a sodium (Na) ion-type ionomer in respective amounts of at least 20 wt %, preferably at least 25 wt %, and more preferably at least 30 wt %.

If necessary, various additives may be included in the above cover material. Examples of such additives that may be included are inorganic fillers and pigments such as zinc oxide, barium sulfate and titanium dioxide, dispersants, antioxidants, ultraviolet absorbers and light stabilizers.

Any of various known methods may be used to form the cover, such as injection molding and compression molding. The cover can easily be formed by suitably selecting such conditions as the injection temperature and time from within the ordinarily used ranges.

Numerous dimples can be formed on the surface of the above-described cover. The number of dimples arranged on the cover surface, while not subject to any particular limitation, is preferably at least 300 but not more than 500, more preferably at least 320 but not more than 450, and even more preferably at least 330 but not more than 440. If the number of dimples is higher than the above range, the ball may have too low a trajectory. Conversely, if the number of dimples is lower than the above range, the ball may assume a high trajectory, and may therefore fail to achieve a sufficient distance when hit with an iron.

The dimples may be of a circular shape, any of various polygonal shapes, a dew drop shape, or an elliptical shape. Any one or combination of two or more of these shapes may be suitably used. For example, if the dimples are circular, dimples having a diameter of at least about 2.5 mm but not more than about 6.5 mm and a depth of at least about 0.08 but not more than about 0.30 mm may be used.

To take full advantage of their aerodynamic properties, it is preferable for the dimples to have a coverage on the spherical surface of the golf ball, expressed as the sum of the individual dimple surface areas defined by the border of the flat plane circumscribed by the edge of the dimple as a proportion of the spherical surface area of the ball were it to have no dimples thereon, of at least 60% but not more than 90%.

Moreover, it is preferable for the value V0 for each dimple, defined as the volume of space in the dimple below a flat plane circumscribed by the edge of the dimple, divided by the volume of a cylinder whose base is the flat plane and whose height is the maximum depth of the dimple from the base, to be in a range of 0.35 to 0.80.

Moreover, it is preferable for the VR value, which is the sum of the dimples volumes below the flat planes circumscribed by the edges of the respective dimples, expressed as a proportion of the volume of golf ball sphere were it to have no dimples thereon, to be at least 0.6% but not more than 1.0%. If the VR value is outside of the above range, the ball when hit may describe a trajectory that is either too high or too low, and may stall as a result.

The golf ball of the invention is not subject to any particular limitation with regard to ball construction, provided it has a core and a cover of one or more layer enclosing the core. That is, the invention is applicable to all types of golf balls, including solid golf balls such as two-piece golf balls and multipiece golf balls having a construction of three or more layers, and thread-wound golf balls.

The golf ball of the invention may be formed to a diameter of generally at least 42.67 mm, and preferably from 42.67 to 43.00 mm, and to a weight of generally from 45.0 to 45.93 g. Moreover, to achieve the objects of the invention, it is desirable for the inventive golf ball to comply with the 2006 R&A Rules of Golf. Specifically, it is desirable for the golf ball to: (1) not pass through a ring having an inside diameter of 42.672 mm, (2) have a weight of not more than 45.93 g, and (3) have an initial velocity of not more than 77.724 m/s.

As explained above, the present invention provides a golf ball that is beneficial for use in competitive play, which ball has a reduced distance compared with official golf balls in current use, yet provides a relatively soft and good feel on impact and minimizes the degree of reduction in distance when hit with an iron, thus having little adverse effect on the amateur golfer.

EXAMPLES

Examples of the invention and Comparative Examples are given below by way of limitation, and not by way of limitation.

Examples 1 and 2

Comparative Examples 1 to 5

Rubber compositions formulated as shown in Table 1 below were prepared for the production of the golf balls in Examples 1 and 2 of the invention and Comparative Examples 1 to 5. These rubber compositions were suitably masticated with a kneader or roll mill, then vulcanized at 155° C. for 15 minutes to form solid cores. Numbers shown for each material

TABLE 1

| | Example | | Comparative Example | | | | |
|---|---|---|---|---|---|---|---|
| Core formulation | 1 | 2 | 1 | 2 | 3 | 4 | 5 |
| BRO1 [1] | 100 | 100 | 100 | 100 | 88.3 | 100 | 100 |
| SBR [2] | 0 | 0 | 0 | 0 | 11.7 | 0 | 0 |
| Zinc acrylate | 19.5 | 19.5 | 19.5 | 23.5 | 23.0 | 35.0 | 26.2 |
| Peroxide (1) [3] | 0.6 | 0.6 | 0.6 | 0.6 | 0.6 | 0.6 | 0.6 |
| Peroxide (2) [4] | 0.6 | 0.6 | 0.6 | 0.6 | 0.6 | 0.6 | 0.6 |
| Antioxidant [5] | 0.1 | 0.1 | 0.1 | 0.1 | 0.1 | 0.1 | 0.1 |
| Zinc oxide | 27.2 | 27.2 | 27.2 | 5.0 | 5.0 | 5.0 | 24.5 |

TABLE 1-continued

| | Example | | Comparative Example | | | | |
|---|---|---|---|---|---|---|---|
| Core formulation | 1 | 2 | 1 | 2 | 3 | 4 | 5 |
| Barium sulfate | 0.0 | 0.0 | 0.0 | 17.5 | 17.9 | 16.0 | 0.0 |
| Organosulfur compound [6] | 0.1 | 0.1 | 0.1 | 0.1 | 0 | 1 | 2.0 |

The above materials are described below. Numbers in the above table represent parts by weight.
[1] A butadiene rubber produced by JSR Corporation under the product name BR01.
[2] SBR1507, produced by JSR Corporation.
[3] Peroxide (1): Dicumyl peroxide, produced by NOF Corporation under the product name Percumyl D.
[4] Peroxide (2): 1,1-Bis(t-butylperoxy)-3,3,5-trimethylcyclohexane, produced by NOF Corporation under the product name Perhexa 3M-40.
[5] Nocrac NS-6, produced by Ouchi Shinko Chemical Industry Co., Ltd.
[6] The zinc salt of pentachlorothiophenol.

Figure 2:
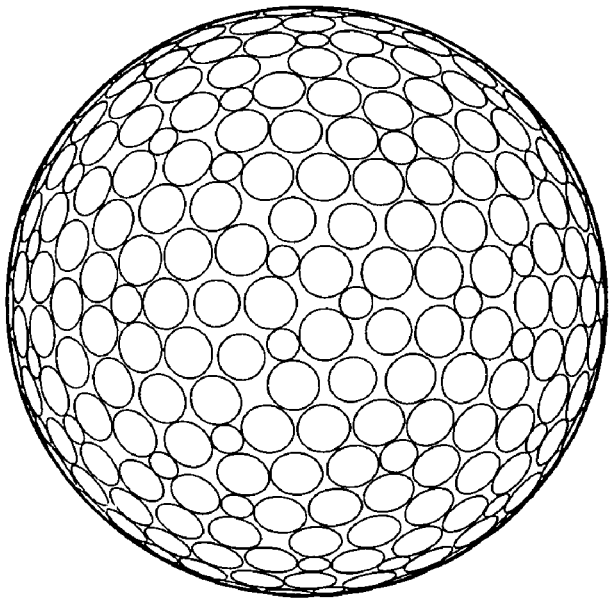
FIG. 2 is a top view of a golf ball showing dimple arrangement pattern II.
Figure 3:
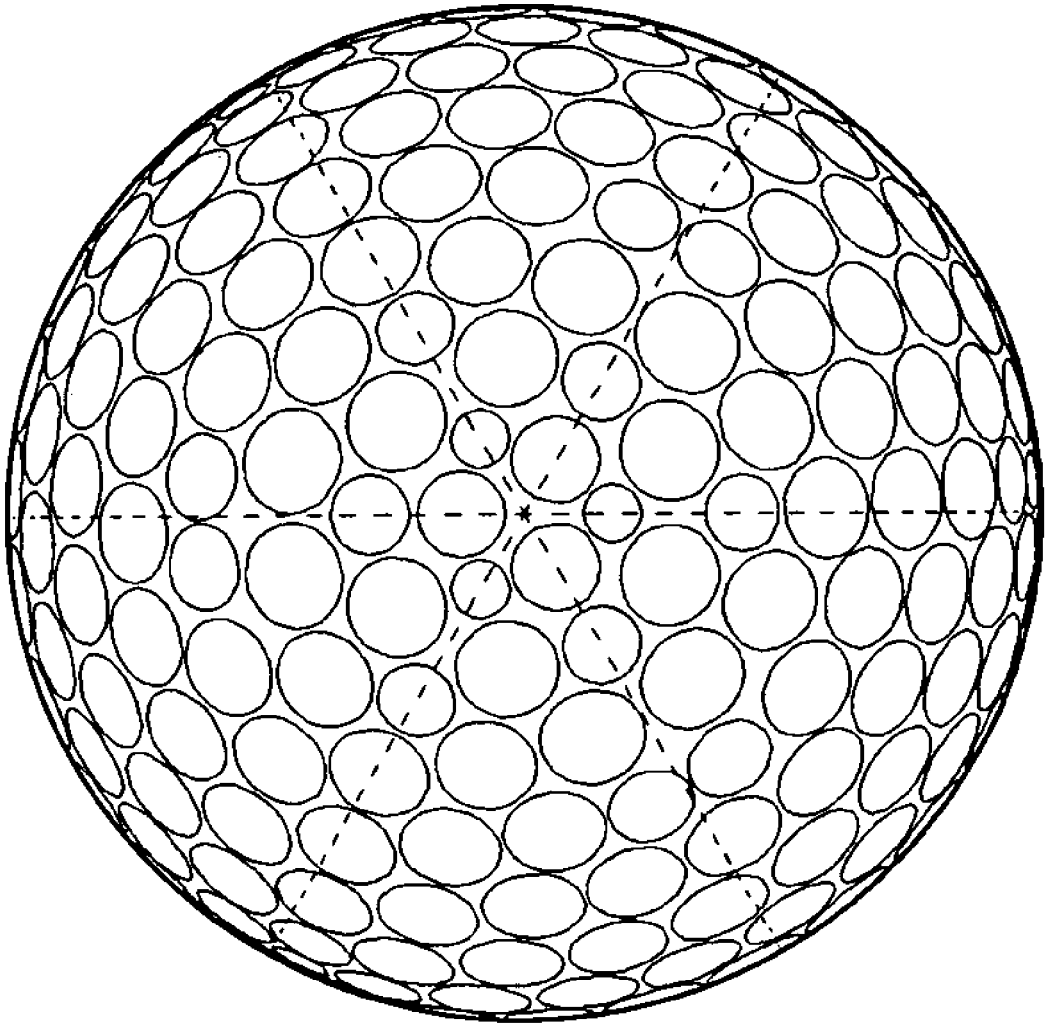
FIG. 3 is a top view of a golf ball showing dimple arrangement pattern III.

Next, the cover material shown in Table 2 below was injection molded over the core, thereby producing a two-piece solid golf ball composed of a core enclosed by a single cover layer bearing numerous dimples on the surface. The cover materials used in each example and the dimple arrangement patterns I, II and III are as shown in Tables 3 to 5 below. FIG. 1 shows dimple arrangement pattern I, FIG. 2 shows dimple arrangement pattern II, and FIG. 3 shows dimple arrangement pattern III.

TABLE 2

| | Grade | Neutralizing ion | A | B | C | D |
|---|---|---|---|---|---|---|
| Cover formulation | H1706 [7] | Zn | | | 50 | 20 |
| | H1557 [7] | Zn | | 50 | | 30 |
| | H1855 [7] | Zn | 35 | | | |
| | H1605 [7] | Na | | | 50 | |
| | H1601 [7] | Na | | 50 | | |
| | S8120 [8] | Na | 35 | | | 50 |
| | AN4311 [9] | | 30 | | | |
| | Polyethylene wax | | | | 2 | |
| | Titanium oxide | | 4 | 4 | 4 | 4 |

Note:
Numbers in the table indicate parts by weight.
[7] An ionomer produced by DuPont-Mitsui Polychemicals Co., Ltd.
[8] An ionomer produced by E. I. DuPont de Nemours & Co.
[9] Produced by DuPont-Mitsui Polychemicals Co., Ltd. under the product name Nucrel.

TABLE 3

Dimple Arrangement Pattern I

| | Number | Diameter (mm) | Depth (mm) | $V_0$ | Volume of one dimple ($mm^3$) | Total volume per type of dimple ($mm^3$) | Surface area of one dimple ($mm^2$) | Total surface area per type of dimple ($mm^2$) | SR (%) | VR (%) | Total dimple volume ($mm^3$) |
|---|---|---|---|---|---|---|---|---|---|---|---|
| 1 | 40 | 4.083 | 0.177 | 0.442 | 1.021 | 40.857 | 13.090 | 523.6 | 75.3 | 0.749 | 305 |
| 2 | 184 | 3.878 | 0.164 | 0.436 | 0.846 | 155.717 | 11.810 | 2,173.1 | | | |
| 3 | 98 | 3.276 | 0.137 | 0.429 | 0.494 | 48.450 | 8.431 | 826.2 | | | |
| 4 | 32 | 4.088 | 0.196 | 0.429 | 1.104 | 35.332 | 13.123 | 420.0 | | | |
| 5 | 16 | 3.905 | 0.182 | 0.433 | 0.944 | 15.110 | 11.975 | 191.6 | | | |
| 6 | 16 | 3.306 | 0.134 | 0.413 | 0.473 | 7.573 | 8.583 | 137.3 | | | |
| 7 | 6 | 2.898 | 0.122 | 0.471 | 0.379 | 2.272 | 6.594 | 39.6 | | | |
| Total | 392 | | | | | 305 | | 4,311.3 | | | |

TABLE 4

| | Dimple Arrangement Pattern II | | | | | | | | | | |
|---|---|---|---|---|---|---|---|---|---|---|---|
| | Number | Diameter (mm) | Depth (mm) | $V_0$ | Volume of one dimple ($mm^3$) | Total volume per type of dimple ($mm^3$) | Surface area of one dimple ($mm^2$) | Total surface area per type of dimple ($mm^2$) | SR (%) | VR (%) | Total dimple volume ($mm^3$) |
| 1 | 240 | 3.883 | 0.154 | 0.494 | 0.899 | 215.868 | 11.839 | 2,841.3 | 75.9 | 0.778 | 317 |
| 2 | 48 | 3.310 | 0.131 | 0.483 | 0.545 | 26.159 | 8.606 | 413.1 | | | |
| 3 | 72 | 2.461 | 0.095 | 0.450 | 0.204 | 14.656 | 4.757 | 342.5 | | | |
| 4 | 42 | 3.865 | 0.172 | 0.498 | 1.005 | 42.215 | 11.732 | 492.8 | | | |
| 5 | 24 | 3.282 | 0.141 | 0.475 | 0.569 | 13.645 | 8.461 | 203.1 | | | |
| 6 | 6 | 3.391 | 0.175 | 0.502 | 0.793 | 4.760 | 9.029 | 54.2 | | | |
| Total | 432 | | | | | 317 | | 4,347.0 | | | |

TABLE 5

| | Dimple Arrangement Pattern III | | | | | | | | | | |
|---|---|---|---|---|---|---|---|---|---|---|---|
| | Number | Diameter (mm) | Depth (mm) | $V_0$ | Volume of one dimple ($mm^3$) | Total volume per type of dimple ($mm^3$) | Surface area of one dimple ($mm^2$) | Total surface area per type of dimple ($mm^2$) | SR (%) | VR (%) | Total dimple volume ($mm^3$) |
| 1 | 12 | 4.573 | 0.138 | 0.481 | 1.089 | 13.065 | 16.425 | 197.1 | 79.8 | 0.757 | 308 |
| 2 | 198 | 4.370 | 0.135 | 0.487 | 0.983 | 194.680 | 14.997 | 2,969.3 | | | |
| 3 | 36 | 3.799 | 0.127 | 0.480 | 0.692 | 24.929 | 11.336 | 408.1 | | | |
| 4 | 6 | 3.450 | 0.135 | 0.472 | 0.596 | 3.578 | 9.349 | 56.1 | | | |
| 5 | 12 | 2.687 | 0.110 | 0.453 | 0.283 | 3.400 | 5.669 | 68.0 | | | |
| 6 | 36 | 4.406 | 0.171 | 0.479 | 1.249 | 44.957 | 15.250 | 549.0 | | | |
| 7 | 24 | 3.822 | 0.161 | 0.468 | 0.864 | 20.725 | 11.472 | 275.3 | | | |
| 8 | 6 | 3.278 | 0.132 | 0.460 | 0.512 | 3.070 | 8.440 | 50.6 | | | |
| Total | 330 | | | | | 308 | | 4,573.6 | | | |

The properties of the golf balls and the properties such as thickness and hardness of the core and cover making up the golf ball in the respective examples of the invention and the comparative examples are shown in Table 6. The flight performance and feel on impact of each ball are shown in Table 7.

TABLE 6

| | | Example | | Comparative Example | | | | |
|---|---|---|---|---|---|---|---|---|
| | | 1 | 2 | 1 | 2 | 3 | 4 | 5 |
| Cover | Material | A | A | B | B | C | D | A |
| | Sheet hardness, Shore D | 48 | 48 | 60 | 60 | 62 | 53 | 48 |
| | Thickness, mm | 2.1 | 2.1 | 2.1 | 1.9 | 1.7 | 2.1 | 2.1 |
| Core | Diameter, mm | 38.55 | 38.55 | 38.55 | 38.9 | 39.3 | 38.55 | 38.55 |
| | Weight, g | 35.5 | 35.5 | 35.5 | 35.8 | 36.9 | 35.2 | 35.5 |
| | Deflection hardness 10-130 kgf (1), mm | 4.5 | 4.2 | 4.5 | 3.8 | 3.4 | 2.6 | 4.1 |
| | Surface hardness, Shore D | 41 | 44 | 41 | 48 | 52 | 61 | 45 |
| | Center hardness, Shore D | 34 | 36 | 34 | 37 | 39 | 42 | 36 |
| Ball | Diameter, mm | 42.7 | 42.7 | 42.7 | 42.7 | 42.7 | 42.7 | 42.7 |
| | Weight, g | 45.4 | 45.4 | 45.4 | 45.2 | 45.5 | 45.3 | 45.4 |
| | Deflection hardness 10-130 kgf (2), mm | 4.3 | 4.1 | 3.6 | 3.2 | 2.8 | 2.3 | 4.0 |
| | Deflection hardness 0.2-5 kgf, mm | 0.39 | 0.36 | 0.26 | 0.25 | 0.2 | 0.19 | 0.36 |
| | Initial velocity, m/s | 76.1 | 76.2 | 77.3 | 77.2 | 77.3 | 77.0 | 76.9 |
| (Initial velocity of ball)/ | | 17.7 | 18.6 | 21.5 | 24.1 | 27.6 | 33.5 | 19.2 |

TABLE 6-continued

| | Example | | Comparative Example | | | | |
|---|---|---|---|---|---|---|---|
| | 1 | 2 | 1 | 2 | 3 | 4 | 5 |
| (Ball deflection hardness 10-130 kgf) | | | | | | | |
| Core deflection - Ball deflection [(1)-(2)] | 0.2 | 0.1 | 0.9 | 0.6 | 0.6 | 0.3 | 0.1 |
| Dimples | I (FIG. 1) | II (FIG. 2) | III (FIG. 3) | II (FIG. 2) | II (FIG. 2) | II (FIG. 2) | II (FIG. 2) |

Deflection (1) The deformation (mm) when the core was subjected to loading from an initial load state of 98 N (10 kgf) to a final load of 1,275 N (130 kgf) was measured. The deformation (mm) when the core was subjected to loading from an initial load state of 1.96 N (0.2 kgf) to a final load of 49 N (5.0 kgf) was also measured.

(2) The deformation (mm) when the ball was subjected to loading from an initial load state of 98 N (10 kgf) to a final load of 1,275 N (130 kgf) was measured.

Shore D Hardness at Surface and Center of Core

Aside from setting the durometer indenter perpendicular to the curved surface of the core, the Shore D hardness at the surface of the core was measured in accordance with ASTM D2240. To measure the Shore D hardness at the center of the core, the core was cut into two halves, and the hardness at the center of the cut face was measured in accordance with ASTM D2240.

Shore D Hardness of Cover

The cover composition was formed under applied heat and pressure to a thickness of about 2 mm, and the resulting sheet was held at 23° C. for 2 weeks, following which the Shore D hardness was measured in accordance with ASTM D2240.

Initial Velocity of Ball

The initial velocity of the ball was measured using an initial velocity measuring apparatus of the same type as the USGA drum rotation-type initial velocity instrument approved by the R&A. The ball was temperature conditioned in a 23±1° C. environment for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity (m/s) of the ball. This cycle was carried out over a period of about 15 minutes.

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of dimple surface areas defined by border of flat plane circumscribed by dimple edge, as a percentage of surface area of ball sphere were it to have no dimples thereon.

VR: Sum of volumes of dimples formed below flat plane circumscribed by dimple edge, as a percentage of volume of ball sphere were it to have no dimples thereon.

TABLE 7

| | | | Example | | Comparative Example | | | | |
|---|---|---|---|---|---|---|---|---|---|
| | | | 1 | 2 | 1 | 2 | 3 | 4 | 5 |
| Flight | W#1 HS, 50 m/s | Total distance, m | 240.2 | 240.7 | 244.3 | 246.5 | 247.1 | 248.3 | 243.6 |
| | | Distance relative to standard ball | −6.1 | −5.6 | −2.0 | 0.2 | 0.8 | 1.9 | −2.7 |
| | | Rating | good | good | NG | NG | NG | NG | NG |
| | W#1 HS, 40 m/s | Total distance, m | 189.1 | 189.7 | 193.3 | 192.1 | 193.0 | 190.0 | 192.3 |
| | | Distance relative to standard ball | −5.2 | −4.6 | −1.0 | −2.2 | −1.3 | −4.3 | −2.0 |
| | | Rating | good | good | NG | NG | NG | good | NG |
| | I#6 HS, 40 m/s | Total distance, m | 148.4 | 148.1 | 148.8 | 147.3 | 145.7 | 144.5 | 148.9 |
| | | Distance relative to standard ball | −1.7 | −2.0 | −1.3 | −2.8 | −4.4 | −5.6 | −1.2 |
| | | Rating | good | good | good | good | NG | NG | good |
| Feel on impact | | | good | good | good | good | NG | NG | good |

Flight

The club was mounted on a golf swing robot, and the distance traveled by the ball when hit at various heads speeds (HS) was measured. The following clubs were used.

(i) HS 50 Tour Stage X500 with loft angle of 8°, manufactured by Bridgestone Sports Co., Ltd.

(ii) HS 40 Tour Stage X500 with loft angle of 10°, manufactured by Bridgestone Sports Co., Ltd.

(iii) I#6 (HS, 40 m/s) Tour Stage X-Blade, manufactured by Bridgestone Sports Co., Ltd.

The flight-performance was rated as follows. In the tests conducted with a number one wood (W#1) at head speeds of 50 and 40 m/s, balls for which the total distance decreased at least 4 m relative to the total distance achieved using the Tour Stage <X☆01S> (2006 model) as the standard ball were rated as "good."

In the tests conducted with a number six iron (I#6) at a head speed of 40 m/s, balls for which the total distance decreased 2 m or less relative to the total distance achieved using the Tour Stage <X☆01S> (2006 model) were rated as "good," and balls for which the total distance decreased more than 2 m were rated as "NG."

Feel

The feel on impact of each ball was sensory evaluated by 20 amateur golfers, and rated as follows.

Good: 15 or more of the golfers rated the ball as having a good, soft feel.

NG: All other balls

The invention claimed is:

1. A golf ball comprising a resilient core made of rubber and a cover of one or more layer enclosing the core, wherein, letting V be the initial velocity (m/s) of the ball as measured by a method set forth in the Rules of Golf using an initial velocity measuring apparatus of the same type as the USGA drum rotation-type initial velocity instrument and letting E be the deflection (mm) of the ball when subjected to loading from an initial load state of 98 N (10 kgf) to a final load of 1,275 N (130 kgf), the value of V/B is at most 19.

2. The golf ball of claim 1, wherein the value of V/B is at most 18.8.

3. The golf ball of claim 1, wherein the deflection E of the ball is at least 2.8 mm.

4. The golf ball of claim 1, wherein the initial velocity V of the ball is at least 65 m/s but not more than 77 m/s.

5. The golf ball of claim 1, wherein the cover has a Shore D hardness of at least 30 but not more than 60.

6. The golf ball of claim 1, wherein, letting S be the deflection (mm) of the core when subjected to loading from an initial load of 98 N (10 kgf) to a final load of 1,275 N (130 kgf), $-0.2 \leqq S-E \leqq 0.5$.

7. The golf ball of claim 1, wherein the ball has a deflection (mm) when subjected to loading from an initial load of 1.96 N (0.2 kgf) to a final load of 49 N (5.0 kgf) of at least 0.27 but not more than 0.6.

8. The golf ball of claim 1, wherein the ball has a diameter, weight and initial velocity in accordance with the R&A Rules of Golf at the time of filing.

9. The golf ball of claim 1, wherein the value V/E is at least 16.0.

10. The golf ball of claim 1, wherein the cover has a thickness of at least 1.5 mm.

11. The golf ball of claim 1, wherein the initial velocity V of the ball is at least 65 m/s.

* * * * *